US005985343A

United States Patent [19]

Hasse, Jr. et al.

[11] Patent Number: 5,985,343

[45] Date of Patent: Nov. 16, 1999

[54] MICROWAVE POPCORN PACKAGE

[75] Inventors: Glenn W. Hasse, Jr., Northfield; William M. Binole, Burnsville; Jerald L. Johnson, Northfield, all of Minn.

[73] Assignee: Ryt-Way Industries, Inc., Northfield, Minn.

[21] Appl. No.: 08/902,724

[22] Filed: Jul. 30, 1997

[51] Int. Cl.[6] ..... B65D 85/72

[52] U.S. Cl. ..... 426/394; 426/107; 426/111; 426/112; 426/113; 426/115; 426/234; 426/241; 426/243; 426/395; 219/727

[58] Field of Search ..... 426/107, 111, 426/113, 115, 118, 234, 241, 242, 395, 394, 112, 243; 219/727

[56] References Cited

U.S. PATENT DOCUMENTS

| | | | |
|---|---|---|---|
| 2,673,805 | 3/1954 | Colman | 426/111 |
| 2,673,806 | 3/1954 | Colman | 426/111 X |
| 3,052,554 | 7/1962 | Colman | 426/111 |
| 3,082,906 | 3/1963 | Reed | 426/111 X |
| 3,140,034 | 7/1964 | Wyman et al. | 426/111 X |
| 3,425,845 | 2/1969 | Dunn | 426/111 |
| 3,671,270 | 6/1972 | Jehn | 426/111 |
| 3,782,976 | 1/1974 | Maier et al. | 426/111 X |
| 3,873,738 | 3/1975 | Zoeller et al. | 426/111 |
| 3,969,535 | 7/1976 | Bourns | 426/111 |
| 4,007,285 | 2/1977 | Maier et al. | 426/111 X |
| 4,038,425 | 7/1977 | Brandberg et al. | 426/111 X |
| 4,260,101 | 4/1981 | Webinger | 426/111 X |
| 4,277,506 | 7/1981 | Austin | 426/111 |
| 4,279,933 | 7/1981 | Austin et al. | 426/111 X |
| 4,448,309 | 5/1984 | Roccafort et al. | 426/111 X |
| 4,453,665 | 6/1984 | Roccaforte et al. | 426/111 X |
| 4,584,202 | 4/1986 | Roccaforte | 426/111 |
| 4,586,649 | 5/1986 | Webinger | 426/111 X |
| 4,734,288 | 3/1988 | Engstrom et al. | 426/107 |
| 5,008,024 | 4/1991 | Watkins | 426/243 X |
| 5,097,107 | 3/1992 | Watkins et al. | 426/243 X |
| 5,214,257 | 5/1993 | Riskey | 426/107 X |
| 5,384,138 | 1/1995 | Robbins, III et al. | 426/111 |
| 5,834,046 | 11/1998 | Turpin et al. | 426/107 |

*Primary Examiner*—Milton Cano

[57] ABSTRACT

A microwave popcorn package including a container having a bottom wall, an open top and a tapered side wall extending from the bottom wall to the open top. The package also includes a substantially planar lid positioned within the container between the bottom wall and the open top to define a popcorn receiving region and to provide a support for the stacking of a plurality of containers. The invention also relates to a method of making and assembling the above container.

24 Claims, 4 Drawing Sheets

MICROWAVE POPCORN PACKAGE

BACKGROUND OF THE INVENTION

1. Field of the Invention

The present invention relates to a popcorn package, and more particularly to a microwave popcorn package which includes a supply of unpopped popcorn and can be placed in a microwave oven and used substantially in the form in which it is purchased. The invention further relates to a microwave popcorn package where the popped popcorn can be consumed directly from the package and a method of assembling the popcorn package of the present invention.

2. Description of the Prior Art

Numerous expandable food packages currently exist in the prior art for accommodating expandable food products such as microwave popcorn. These packages are designed to both store the popcorn in its uncooked or unpopped condition and to provide a serving container for the popcorn in its popped condition. An early microwave popcorn package comprises an expandable paper bag into which the unpopped popcorn, cooking oils, seasonings etc. are placed. The bag is folded for compact storage and sale. Application of microwave energy causes the popcorn to pop and the bag to expand to contain the product. A further package comprises an expandable cardboard container which is first opened and the popcorn kernels, cooking oils, etc. placed directly into the bottom of the package. A still further prior art package comprises an outer cardboard container in which the unpopped popcorn is contained within a plastic food pouch which is sealed to provide the popcorn with a relativity long shelf life. This permits popcorn to be stored for extended periods of time on grocery store shelves and in inventory without refrigeration. An example of this package is exemplified by Engstrom et al. U.S. Pat. No. 4,734,288.

Tub shaped microwave popcorn packages to simulate popcorn containers at movie theaters also exist and are exemplified by U.S. Pat. Nos. 5,008,024 and 5,097,107 issued to Watkins. These packages are generally tub shaped, with slopping side walls to enable the packages to be stacked during storage, shipment or display. A limitation of the packages described in both of these Watkins patents, however, is the requirement that the flexible cover containing the unpopped popcorn be secured to, and extend downwardly from, the upper open mouth of the container. This results in increased fabrication costs. Increased fabrication costs for these prior art tub containers also result because modified flexible covers and modified production apparatus and methods are required for containers of different sizes.

Accordingly, there is a need in the art for an improved microwave popcorn package, and particularly, an improved, tub shaped microwave popcorn package which facilitates improved production efficiencies and reduced production costs, for packages of the same size as well as packages of differing size.

SUMMARY OF THE INVENTION

In contrast to the prior art, the present invention provides an improved microwave popcorn package, and in particular an improved tub-type microwave popcorn package, which significantly improves the manufacturing efficiencies of the package and thus significantly reduces the production costs.

More specifically, the microwave popcorn package of the present invention comprises a generally tub shaped container of the type having a bottom wall, an open top and a side wall which extends from the bottom wall to the open top. The side wall is tapered outwardly as it extends from the bottom wall to the open top to facilitate the stacking of a plurality of the containers during storage, shipment or display. The package of the present invention further includes a lid or intermediate wall member which is positioned between the open top and the bottom wall to define a popcorn receiving region between the lid and the bottom wall. In one embodiment, the lid is not directly connected with any portion of the container, but is retained in its operative position within the container solely by engagement between its outer peripheral edge and the inner surface of the side wall. In a second embodiment, the lid is retained relative to the inner surface of the side wall at one or more locations by a heat sensitive adhesive. A supply of unpopped popcorn is provided in the popcorn receiving region between the lid and the bottom wall. Preferably this supply of unpopped popcorn is provided in a closed pouch which, during storage, shipment and display, is free of any fixed connection with any portion of the container. If desired, a portion of the bottom wall and/or the inner surface of the side wall can be provided with a coating which becomes tacky when exposed to microwave energy to thereby limit the popcorn containing pouch from any shifting during the popping process.

Accordingly, it is an object of the present invention to provide an improved microwave popcorn package, and in particular an improved tub-type popcorn package which overcomes the limitation of the prior art.

Another object of the present invention is to provide an improved tub shaped microwave popcorn package in which the popcorn is supplied in a closed pouch which is free of any connection to the container during storage, shipment or display.

A further object of the present invention is to provide a microwave popcorn package having an intermediate wall member or lid defining a popcorn receiving region which is free of any fixed connection with the container or which is retained relative to the container by a heat sensitive adhesive that is released when the popcorn is popped.

A still further object of the present invention is to provide a method of making and/or assembling the improved microwave popcorn package in accordance with the present invention.

These and other objects of the present invention will become apparent with reference to the drawings, the description of the preferred embodiment and the appended claims.

DESCRIPTION OF THE PREFERRED EMBODIMENT

Figure 1:
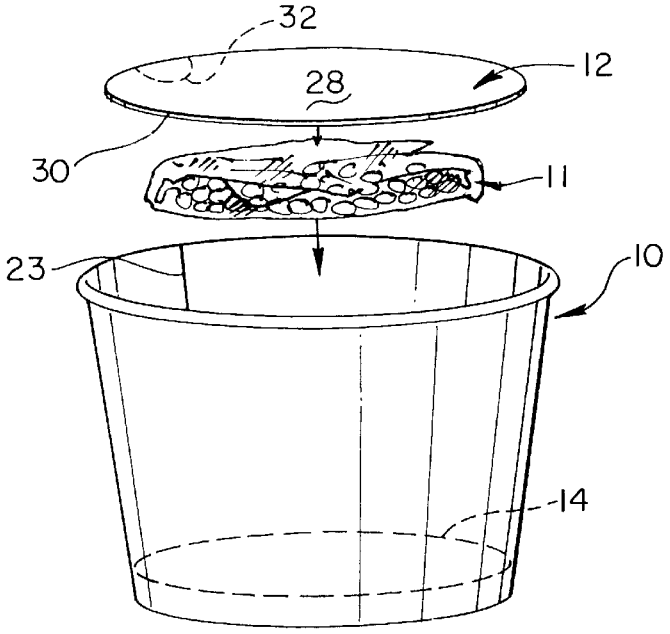
FIG. 1 is an isometric, exploded view of one embodiment of the microwave popcorn package of the present invention with portions illustrated in broken lines.
Figure 2:
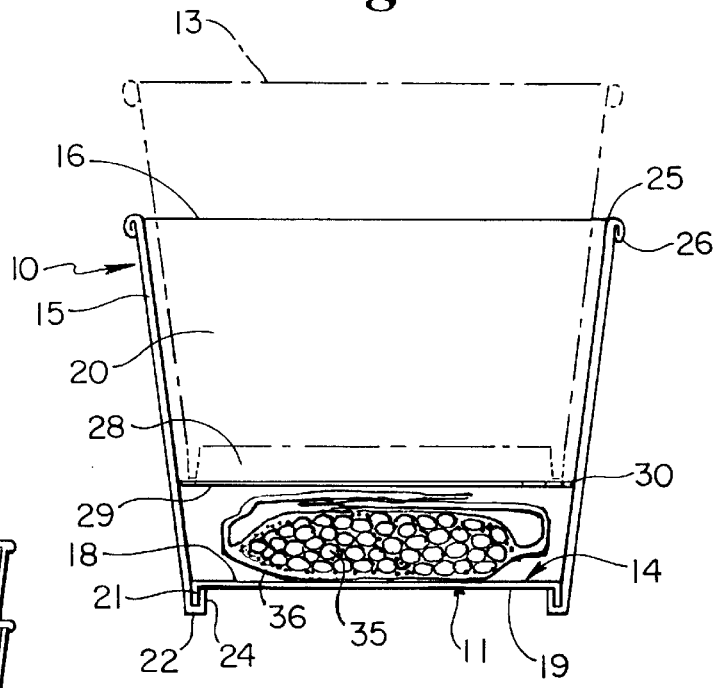
FIG. 2 is a side sectional view of the microwave popcorn package of FIG. 1 and also showing a second container, in phantom, in a stacked relationship relative to the first.
Figure 3:
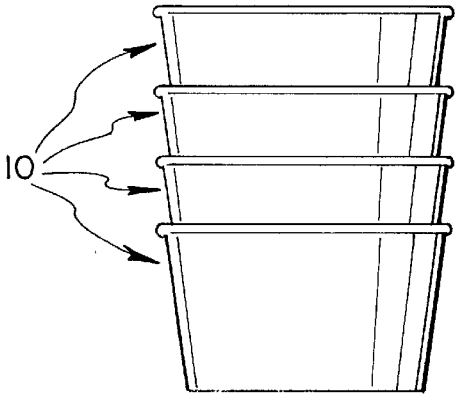
FIG. 3 is a side elevational view showing a plurality of microwave popcorn packages of the present invention in a stacked relationship.

With reference to FIGS. 1 and 2, the microwave popcorn package of the present invention includes a generally tub shaped container 10, a supply of unpopped popcorn 11 and a lid or intermediate wall member 12. The tub shaped container 10 includes a bottom wall 14, an open top 16 and a side wall 15. As illustrated best in FIGS. 1 and 2, the side wall 15 is tapered outwardly from the bottom wall 14 as it extends to the open top 16. This taper enables a plurality of packages to be stacked relative to one another during storage, shipment or display. FIG. 2 illustrates a second container 13 in phantom being stacked relative to the first container 10, while FIG. 3 illustrates four such containers 10 being stacked relative to one another.

The bottom wall 14 in the preferred embodiment has a generally circular peripheral configuration, a top planar surface 18 facing the interior 20 of the container and a bottom planar surface 19 facing a direction opposite that of the container interior 20. A peripheral leg 21 extends downwardly from the outer peripheral edge of the wall 14 for connection with the side wall 15.

The lower end 22 of the side wall 15 includes a portion 24 wrapped around and secured to the leg 21 of the bottom wall 14 as shown best in FIG. 2. This particular tub construction, which includes a side wall seam 23 (FIG. 1), is known in the art. With this construction, the bottom wall 14 is spaced upwardly from the bottom edge 22 for a short distance. This spacing is on the order of ¼ to 1 inch and preferably about ½ for a 64 oz. tub.

The side wall 15 terminates at a top edge 25 to define the open top 16. An outwardly curled reinforcing rim 26 is provided at the top edge 25 for providing rigidity to the container 10 and the open top 16. The formation of the rim 26 is known in the art. The side wall 15 includes a tapered inner surface extending from the bottom wall 14 to the top edge 25 and defining the interior 20 of the container 10. The outer surface of the side wall extends from the bottom edge 22 to the top edge 25.

Figure 4:
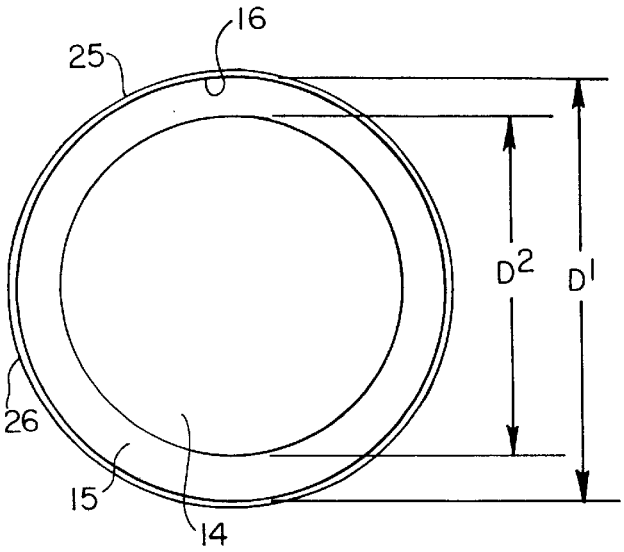
FIG. 4 is a top elevational view of the microwave popcorn package of the present invention without the supply of unpopped popcorn and without the lid.

As illustrated best in FIG. 4, the open top has a generally circular peripheral configuration defined by the top edge 25 of the side wall 15 and has a diametrical dimension $D^1$ greater than the diametrical dimension $D^2$ of the circular peripheral configuration of the bottom wall 14. Because of the differences in the diametrical dimensions $D^1$ and $D^2$ of the open top 16 and the bottom wall 14, respectively, the side wall 15 slopes or tapers outwardly as it extends from the bottom wall 14 to the open top 16. This tapered wall permits adjacent containers to be stacked relative to one another. In the preferred embodiment, the taper angle of the side wall 15 is about 3 to 20 degrees and preferably less than about ten degrees.

In the preferred embodiment, the bottom wall 14 and side wall 15 are constructed of a relativity stiff paper or paper board material which is microwave transparent and is bleached on both sides. It is contemplated, however, that other materials could be used as well. It is also contemplated that the bottom wall 14 and the open top 16 could have configurations other than circular configurations, such as square, rectangular, oval or the like. Preferably, both the bottom wall 14 and the open top 16 have similar or identical peripheral configurations, however, this is not an absolute necessity.

Figure 5:
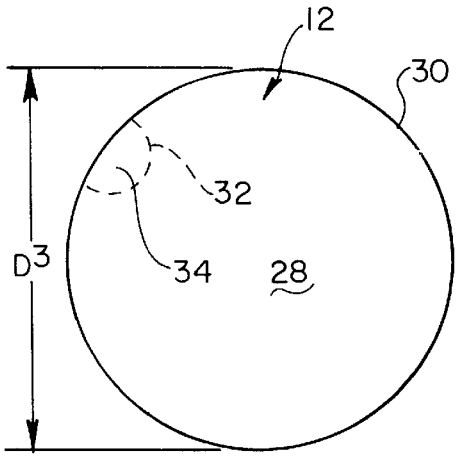
FIG. 5 is an elevational top view of the lid of the microwave popcorn package shown in FIG. 1.

The embodiment of the lid or intermediate wall member 12 of FIGS. 1, 2 and 5 includes a top planar surface 28, a bottom planar surface 29 and an outer peripheral edge 30 defining a peripheral configuration of the lid 12. In the preferred embodiment, the peripheral configuration of the lid 12 is circular and the diametrical dimension $D^3$ (FIG. 5) is less than the diametrical dimension $D^1$ of the open top 16 and greater than the diametrical dimension $D^2$ of the bottom wall 14. This dimensional relationship results in the outer peripheral edge 30 engaging the inner surface of the side wall 15 when the lid 12 is inserted within the interior 20 of the container 10.

As shown best in FIG. 2, insertion of the lid 12 into the container 10 results in the lid 12 being positioned between the bottom wall 14 and the open top 16 to define a popcorn receiving region 31 between the top surface 18 of the bottom wall 14 and the bottom surface 29 of the lid 12. Preferably the dimensions $D^1$, $D^2$ and $D^3$ are such that when the lid 12 is inserted into the container 10, its outer peripheral edge 30 will engage the inner surface of the side wall 15 and be retained at a position which is closer to the bottom wall 14 then the open top 16. The embodiment of the lid 12 is retained in this position solely by engagement between its outer peripheral edge 30 and the inner surface of the side wall 15 and is free of any other connection with the container 10.

When the lid 12 is positioned as shown in FIG. 2, the top surface 28 provides a support surface for an adjacent, stacked container 13. This embodiment of the lid 12 also includes a removal means for manually removing the lid 12 from the container 10, if desired. In the embodiment of FIGS. 1 and 5, this removal means includes the removal opening 32 positioned at the peripheral edge 30 of the lid 12. The removal opening 32 is scored so that the material 34 defined by the score line can be manually removed merely by exerting a force against the material 34 by a finger of the user. Preferably the peripheral configuration of the lid 12 is circular, although it could comprise other shapes as well. Further, it is preferable for the peripheral configuration of the lid 12 to be the same as that of the bottom wall 14 and the open top 16. Certain features of the present invention can, however, still be realized even if the lid 12 has a different peripheral configuration. For example, a polygonal shaped lid such as a hexagon, octagon, etc. can be used with a container having a circular open top.

The lid 12 is preferably constructed of a microwave transparent paper or paper board which has sufficient stiffness to enable it to perform its intended functions, namely, to be retained in the container 10 as a result of engagement between the outer peripheral edge 30 and the side wall 15, to define the popcorn receiving region 31 and to support one or more containers in a stacked configuration as shown in FIGS. 2 and 3. A paper board material having a thickness between 0.02 and 0.04 inches will provide sufficient stiffness for the lid 12 to perform the above functions. Preferably, the lid 12 is bleached on its top side 28, with its bottom side 29 being substantially free of any coatings.

Figure 8:
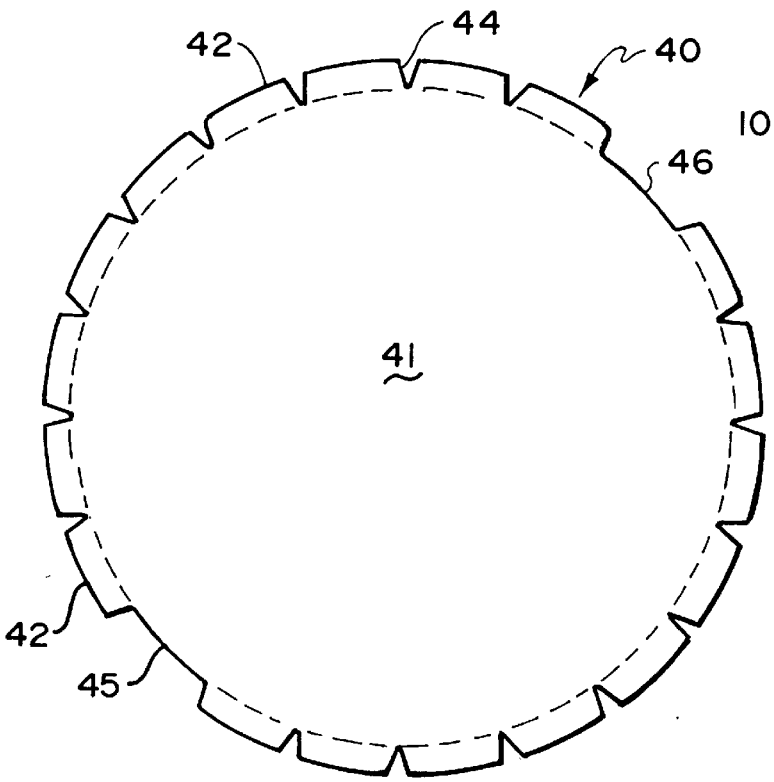
FIG. 8 is an elevational top view of a further embodiment of a lid for the microwave popcorn package of the present invention.
Figure 11:
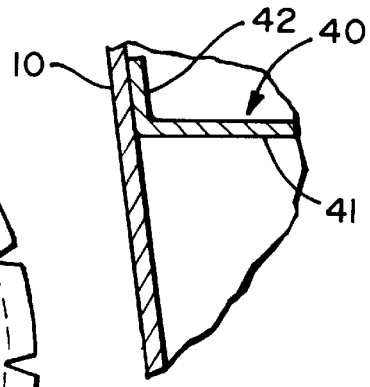
FIG. 11 is a view, partially in section, as viewed along the section line 11—11 of FIG. 9.
Figure 9:
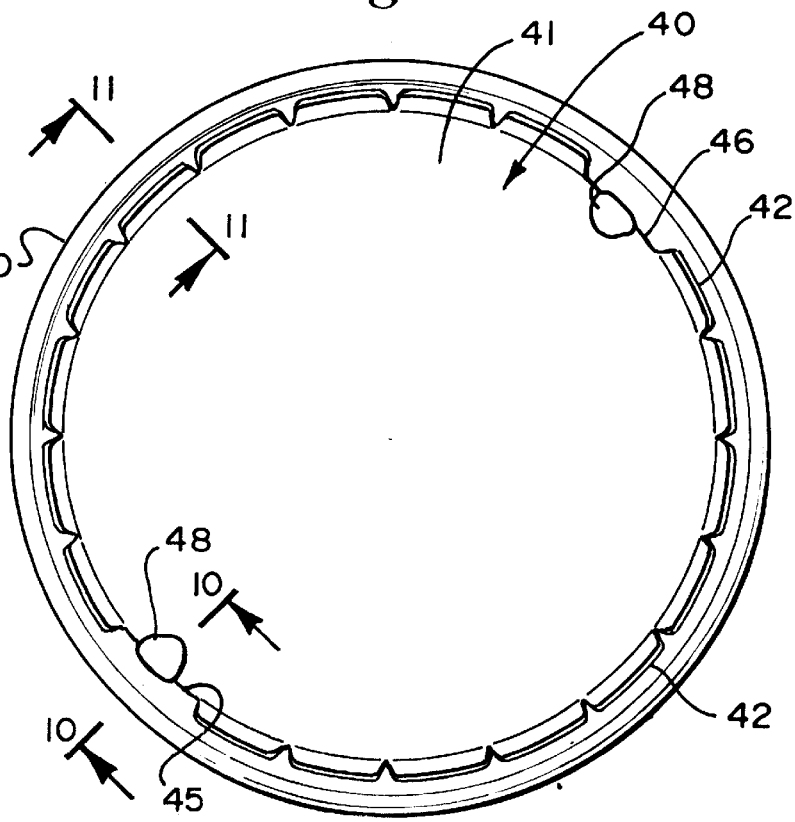
FIG. 9 is an elevational top view of an assembled microwave popcorn package of the present invention with the lid of FIG. 8.

FIG. 8 shows a further embodiment of a lid 40 useable with the microwave popcorn container of the present invention. The embodiment of the lid 40 includes a central lid portion 41 with a circular peripheral edge and a plurality of outwardly extending retaining tabs 42 positioned about the circular peripheral edge. The tabs 42 are generally trapezoidally shaped and are separated from one other around the peripheral edge by generally triangular shaped openings 43. This permits the tabs to be bent upwardly during insertion of the lid 40 into the container 10 as shown in FIGS. 9 and 11. As shown, the tabs are bent upwardly along the outer peripheral edge of the central lid portion 41.

Figure 10:
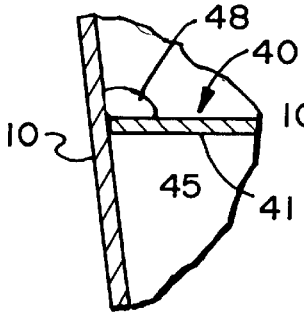
FIG. 10 is a view, partially in section, as viewed along the section line 10—10 of FIG. 9.

As illustrated in FIG. 8 the tabs 42 extend continuously around the entire peripheral edge except at two diametrically opposite locations 45 and 46. As shown best in FIGS. 9 and 10, a drop or bead of heat sensitive adhesive 48 is provided at these points to assist in retaining the lid 40 within the interior of the container 10 and to prevent the lid 40 and the contents within the container from inadvertently falling out or being removed or tampered with prior to use. In the preferred embodiment, the adhesive 48 is a heat sensitive adhesive which, when exposed to microwave energy sufficient to pop popcorn, releases to allow the lid 40 to move upwardly relative to the inner surface of the container 10. The embodiment of FIGS. 8 and 9 contemplate the adhesive 48 being applied at two diametrically opposite locations; however, adhesive 48 may be applied at only a single location or at more than two locations about the periphery of the lid 40. Adhesive may also be used with the lid construction 12 shown in FIGS. 1, 2 and 5, if desired. In place of the one or more drops or beads of adhesive securing the lid to the inner surface of the container 10, it is also contemplated that the lid 12 of FIG. 5 or the lid 40 of FIG. 8 could be continuously secured to the inner surface of the container 10 by a heat sensitive adhesive around the entire peripheral edge of the lids 12 or 40.

Figure 12:
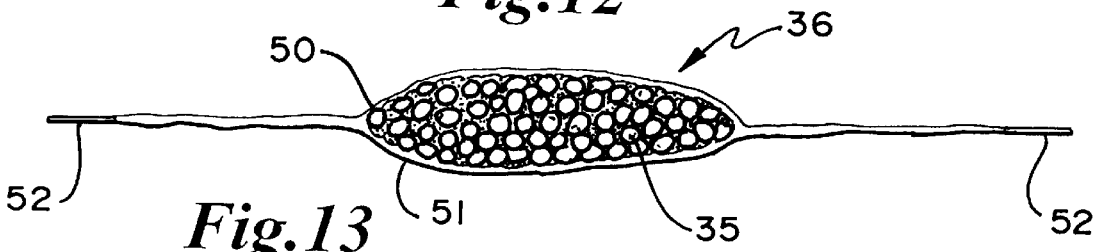
FIG. 12 is a side elevational view, partially in section, of the popcorn supply pouch usable with the package of the present invention.

Positioned within the popcorn receiving region 31 as best shown in FIG. 2, is a supply of unpopped popcorn 35. It is preferred for this unpopped popcorn 35 to be contained within a closed or sealed pouch 36 together with the popping oil, salt and other seasonings. Preferably the pouch 36 is an expandable pouch constructed of a film material which is substantially impermeable to oxygen and moisture so that it is capable of maintaining the freshness of the contained popcorn, oil and seasonings for a commercially acceptable period of time. The construction of the pouch 36 in accordance with the present invention is similar to that of the pouch disclosed in U.S. Pat. No. 4,734,288, the substance of which is incorporated herein by reference. As shown best in FIG. 12, the pouch 36 is comprised of a top film layer 50 and a bottom film layer 51 which are sealed along their outer peripheral edges 52. The central portion of the pouch is provided with unpopped popcorn 35 and the oils and seasonings for popping the popcorn. Preferably the pouch 36 is free of any connection to the bottom wall, the side wall or any other part of the container prior to use, i.e., during storage, shipment or display.

Figure 7:
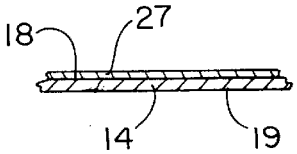
FIG. 7 is a fragmentary sectional view of a portion of the bottom wall showing a coating thereon.

If desired, all or a portion of the top surface 18 of the bottom wall 14 and all or a portion of the inner surface of the side wall 15 may be coated with a material which is solid at room temperature and which, when exposed to microwave energy sufficient to pop the popcorn, softens and becomes tacky. This in turn results in portions of the pouch 36 fusing or sticking to this tacky coating. This prevents the pouch 36 from shifting within the container 10 during the popping process or while the popcorn is being consumed. An example showing such a coating 27 on the top surface of the bottom wall 14 is shown in FIG. 7. The details of such a coating are fully described in U.S. Pat. No. 4,734,288, the substance of which is incorporated herein by reference.

Figure 13:
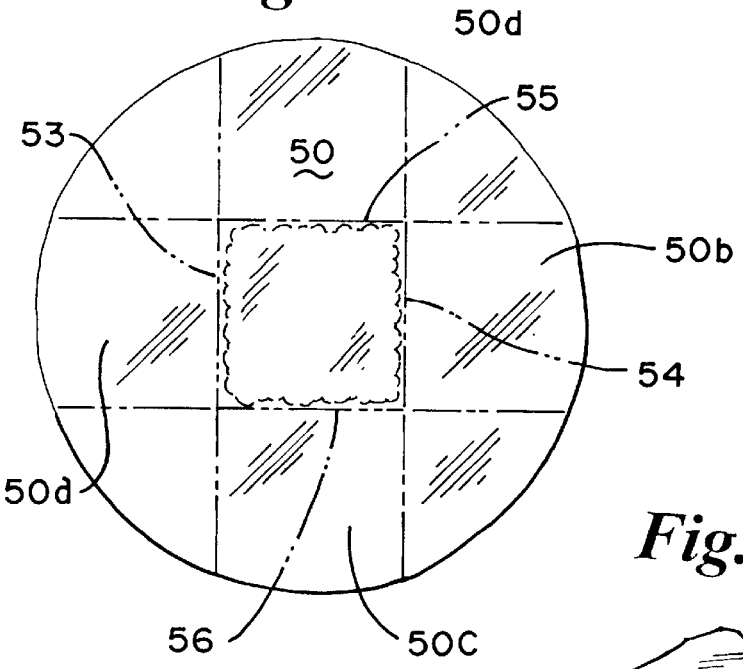
FIG. 13 is an elevational plan view of the popcorn supply pouch showing pouch fold lines.
Figure 14:
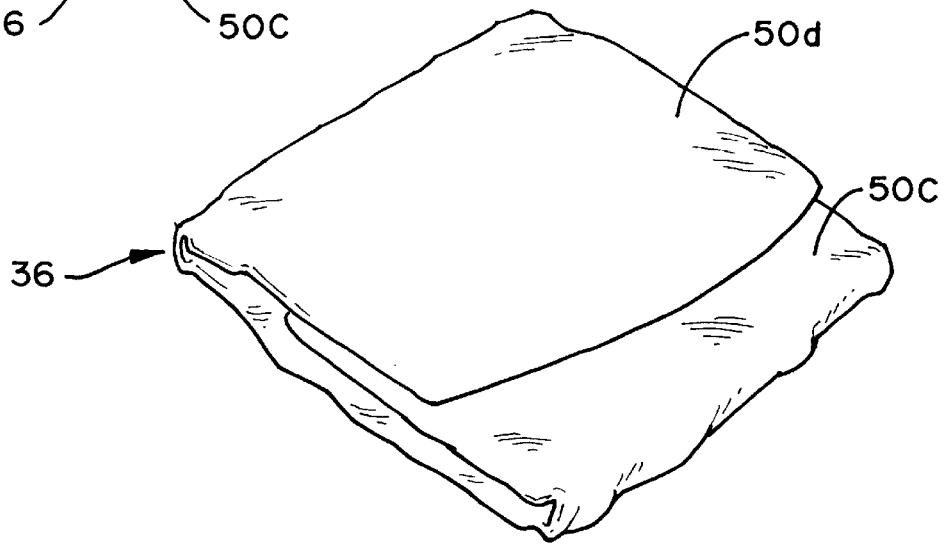
FIG. 14 is an isometric view showing the pouch in its folded position for placement in the tub.

Prior to the placement of the pouch 36 into the container 10, it is preferable for the outer portions of the pouch to be folded inwardly and toward the open top in the manner shown in FIGS. 13 and 14. In FIG. 13, the outer portions 50*a* and 50*b* are first folded inwardly along the fold lines 53 and 54. Next, the outer portions 50*c* and 50*d* are folded inwardly along the fold lines 55 and 56. This results in a folded pouch as shown in FIG. 14.

Folding the outer portions of the pouch 36 inwardly and toward the open top prior to placement in the container 10 accomplishes several things. First, it prevents the top film layer 50 from prematurely contacting and sticking to the side wall 15 during the popping process. Secondly, it causes the bottom film layer 51 to contact and stick to the side wall 15 at a higher position, resulting in a fuller looking container when the popping process is complete. Thirdly, folding the outer portions of the pouch inwardly and toward the open top facilitates the lid 12 rising more evenly. It is not required for the pouch to be folded exactly as shown and described in FIGS. 13 and 14. However, it is preferable for the outer edges or portions of the pouch be folded or gathered inwardly and toward the open top prior to placement in the container 10.

The method aspect of the present invention includes providing a tub shaped container having a bottom wall, an open top and an outwardly tapered side wall extending between the bottom wall and the open top and further providing an intermediate wall member or lid having a peripheral configuration and dimensions which enable it to be inserted into the container and retained in a position between the bottom wall and the open top. Still further method steps include introducing a sealed, expandable pouch containing unpopped popcorn into the container so that it rests on the bottom wall 14 and inserting the lid into the container so that it engages the side wall and is maintained in a position above the popcorn. Prior to placement of the pouch into the container, it is preferably folded as described above. In one embodiment of the present invention, the pouch and the lid are free of any fixed connection with the container during storage, shipping or display. In a second embodiment, one or more beads of adhesive, or a continuous strip of adhesive, are provided about the peripheral edge of the lids 12 or 40 to secure the same to the inner surface of the container 10.

Figure 6:
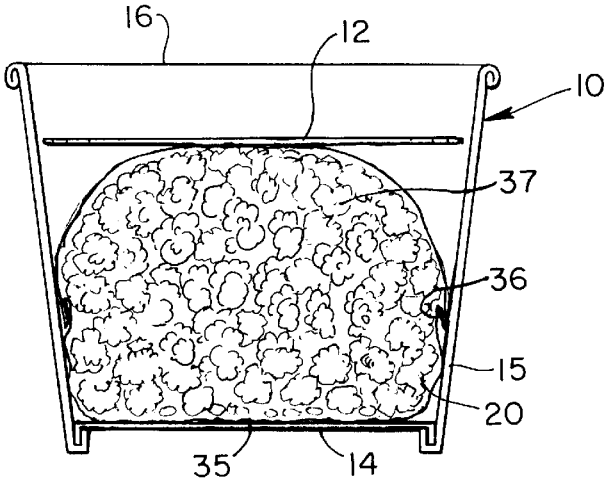
FIG. 6 is a side sectional view similar to that of FIG. 2 with the popcorn partially popped.

FIG. 6 illustrates the package of the present invention during the microwave corn popping process. When it is desired to pop popcorn using the package of the present invention, the package, with the pouch 36 and the lid positioned as shown in FIG. 2 are placed into a microwave oven. It is not necessary to remove the lid 12 prior to popping. In fact, if the lid 12 or 40 is glued to the container 10, it is intended that the lid not be removed prior to cooking. During cooking and popping of the popcorn, the lid 12 or 40 will merely rise upwardly through the container 10 as the popcorn is popped as shown in FIG. 6.

Although the description of the preferred embodiment has been quite specific, it is contemplated that various modifications could be made without deviating from the spirit of the present invention. Accordingly, it is intended that the scope of the present invention be dictated by the appended claims rather than by the description of the preferred embodiment.

I claim:

1. A microwave popcorn package comprising:

a container having a bottom wall, an open top and a tapered side wall with an inner surface extending from said bottom wall to said open top, said side wall being tapered outwardly from said bottom wall toward said open top to facilitate stacking of a plurality of said containers;

a lid having a peripheral edge engaging said inner surface of said side wall and being positioned between said open top and said bottom wall to define a popcorn receiving region between said lid and said bottom wall;

a supply of unpopped popcorn in said popcorn receiving region; and said lid having dimensions smaller than said open top so that when said popcorn pops, said popped popcorn causes movement of said lid toward said open top with said peripheral edge spaced inwardly from the inner surface of said side wall, said lid further being substantially planar wherein said lid maintains its substantially planar configuration while engaged with said inner surface between said open top and said bottom wall and during movement of said lid toward said open top.

2. The microwave popcorn package of claim 1 wherein said supply of unpopped popcorn includes a closed pouch containing unpopped popcorn.

3. The microwave popcorn package of claim 2 wherein said closed pouch is expandable and is free of any fixed connection to said container.

4. The microwave popcorn package of claim 1 wherein said open top includes an open top peripheral configuration, said bottom wall includes a bottom wall peripheral configuration and said lid includes a lid peripheral configuration and wherein said open top peripheral configuration and said lid peripheral configuration are the same.

5. The microwave popcorn package of claim 4 wherein each of said open top peripheral configuration, said bottom wall peripheral configuration and said lid peripheral configuration is a circle.

6. The microwave popcorn package of claim 5 wherein each of said bottom wall, said open top and said lid includes a diametrical dimension and wherein the diametrical dimension of said lid is less than the diametrical dimension of said open top and greater than the diametrical dimension of said bottom wall.

7. The microwave popcorn package of claim 6 wherein said lid is retained within said container solely by engagement between said outer peripheral edge and said side wall.

8. The microwave popcorn package of claim 1 wherein said lid is constructed of a stiff paperboard.

9. The microwave popcorn package of claim 1 wherein said lid includes at least one retaining tab positioned about said peripheral edge.

10. The microwave popcorn package of claim 9 wherein said at least one retaining tab is bent toward said open top upon positioning of said lid between said open top and said bottom wall.

11. The microwave popcorn package of claim 1, wherein a plurality of said microwave popcorn packages are stacked adjacent to one another with each adjacent higher stacked package supported on the lid of the adjacent lower package.

12. The plurality of popcorn packages of claim 11, wherein each popcorn package has a supply of unpopped popcorn in said popcorn receiving region of each container.

13. The microwave popcorn package of claim 1 wherein a portion of said bottom wall and/or side wall includes a coating which becomes soft and tacky when exposed to microwave energy.

14. The microwave popcorn package of claim 1 wherein said lid is positioned closer to said bottom wall than said open top.

15. A microwave popcorn package comprising:

a container having a bottom wall, an open top and a tapered side wall extending from said bottom wall to said open top, said side wall being tapered outwardly from said bottom wall toward said open top to facilitate stacking of a plurality of said containers;

a lid positioned between said open top and said bottom wall to define a popcorn receiving region between said lid and said bottom wall wherein said lid is smaller than said open top and includes a peripheral edge and said lid is retained in a planar position between said open top and said bottom wall by adhesive applied at one or more locations between said peripheral edge and said container side wall.

16. The microwave popcorn package of claim 5 wherein said adhesive is a heat sensitive adhesive which releases upon application of microwave energy sufficient to pop popcorn.

17. A microwave popcorn package comprising:

a generally tub shaped container having a bottom wall with a generally circular configuration and diametrical bottom wall dimension, an open top with a generally circular configuration and a diametrical open top dimension and a side wall extending from said bottom wall to said open top, said diametrical bottom wall dimension being less than said diametrical open top dimension and said side wall being tapered outwardly from said bottom wall toward said open top dimension and said side wall being tapered outwardly from said bottom wall toward said open top;

a lid with a generally circular and substantially planar configuration defined by a peripheral edge and a diametrical lid dimension, said diametric lid dimension being less than the diametric open top dimension and greater than the diametric bottom wall dimension and being retained in a position between said open top and said bottom wall with said peripheral edge engaging said side wall to define a popcorn receiving region between said lid and said bottom wall and with said lid being maintained in said substantially planar configuration when said peripheral edge engages said side wall; and a supply of unpopped popcorn disposed in said popcorn receiving region.

18. The microwave popcorn package of claim 17 wherein said lid is positioned closer to said bottom wall than said open top.

19. The microwave popcorn package of claim 18 wherein said lid includes a plurality of retaining tabs positioned about said peripheral edge, said retaining tabs being bendable upwardly toward said open top.

20. The microwave popcorn package of claim 19 wherein said lid is retained in position between said open top and said bottom wall by adhesive applied at one or more locations between said peripheral edge and said container side wall.

21. The microwave popcorn package of claim 20 wherein said plurality of retaining tabs extend continuously around said peripheral edge except at said locations where said adhesive is applied.

22. A method of making and assembling a microwave popcorn package comprising:

providing a container having a bottom wall, an open top and a tapered side wall extending between said bottom wall and said open top, said side wall tapering outwardly from said bottom wall toward said open top;

providing a substantially planar lid having a peripheral edge and having dimensions smaller than the dimensions of said open top to enable said lid to be inserted through said open top;

inserting an expandable closed pouch containing unpopped popcorn into said container through said open top so that said pouch is supported by said bottom wall;

inserting said lid into said container through said open top until said peripheral edge of said lid engages said tapered side wall between said bottom wall and said open top so that said lid is retained within said container between said bottom wall and said open top in its substantially planar form; and stacking a plurality of said containers by inserting a second container through said open top so that said second container is supported by said lid.

23. The method of claim 22 including retaining said lid between said bottom wall and said open top by a heat sensitive adhesive.

24. The method of claim 22 including folding the outer portions of said pouch inwardly and inserting the pouch into the container so that the folded portions face said open top.

* * * * *

UNITED STATES PATENT AND TRADEMARK OFFICE

CERTIFICATE OF CORRECTION

PATENT NO. : 5,985,343
DATED : November 16, 1999
INVENTOR(S) : Glenn W. Hasse, Jr. et al.

It is certified that error appears in the above-identified patent and that said Letters Patent is hereby corrected as shown below:

Column 7,
Line 58, should read -- includes a peripheral edge and at least --

Signed and Sealed this

Sixth Day of November, 2001

*Attest:*

Nicholas P. Godici

NICHOLAS P. GODICI
*Acting Director of the United States Patent and Trademark Office*

*Attesting Officer*